US007709424B2

(12) United States Patent
Shimura et al.

(10) Patent No.: US 7,709,424 B2
(45) Date of Patent: May 4, 2010

(54) LUBRICATING OIL COMPOSITION AND GREASE COMPOSITION TECHNICAL FIELD

(75) Inventors: Akihiko Shimura, Kitaibaraki (JP); Tatsuya Hashimoto, Kitaibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 509 days.

(21) Appl. No.: 11/791,306

(22) PCT Filed: Nov. 24, 2005

(86) PCT No.: PCT/JP2005/021526

§ 371 (c)(1),
(2), (4) Date: May 21, 2007

(87) PCT Pub. No.: WO2006/057273

PCT Pub. Date: Jun. 1, 2006

(65) Prior Publication Data

US 2007/0298988 A1 Dec. 27, 2007

(30) Foreign Application Priority Data

Nov. 25, 2004 (JP) ..... 2004-339862

(51) Int. Cl.

| | |
|---|---|
| ***C10L 1/18*** | (2006.01) |
| ***C10M 129/20*** | (2006.01) |
| ***C10M 171/00*** | (2006.01) |
| ***C08K 5/01*** | (2006.01) |
| ***C09G 3/00*** | (2006.01) |

(52) U.S. Cl. ..... 508/306; 508/319; 508/590; 508/307

(58) Field of Classification Search ..... 508/306–307, 508/319, 590

See application file for complete search history.

(56) References Cited

FOREIGN PATENT DOCUMENTS

| | | |
|---|---|---|
| JP | 61-254697 | 11/1986 |
| JP | 06-136379 | 5/1994 |
| JP | 2003-027079 | 1/2003 |
| JP | 2003-176831 | 6/2003 |
| JP | 2004-108442 | 4/2004 |
| JP | 2005-154759 | 6/2005 |
| WO | WO 99/51612 | 10/1999 |

*Primary Examiner*—Walter D Griffin
*Assistant Examiner*—Frank C Campanell
(74) *Attorney, Agent, or Firm*—Brinks Hofer Gilson & Lione

(57) ABSTRACT

A lubricating oil composition, which comprises a perfluoropolyether base oil, and a fluorine-containing polyether diphosphonic acid ester, represented by the following general formula:

$$(R_2O)(R_1O)P(O)(CH_2)_aCF(CF_3)[OCF_2CF(CF_3)]_bO(CF_2)_cO[CF(CF_3)CF_2O]_dCF(CF_3)(CH_2)_eP(O)(OR_3)(OR_4)$$

(where $R_1$, $R_2$, $R_3$, and $R_4$ are hydrogen atoms, alkyl groups, cycloalkyl groups, aryl groups, alkylaryl groups, aralkyl groups, or any of the foregoing groups can be halogen atom-substituted groups, subscripts a, b, c, d, and e are in conditions of $2 \leqq a+e \leqq 8$, $b+d \leqq 28$, and $1 \leqq c \leqq 10$, and b and d can be 0), and a grease composition which further contains a thickening agent in addition to the lubricating oil composition, have distinguished abrasion resistance and rust preventiveness without deteriorating the heat resistance inherent in the lubricating oil and the grease containing a perfluoropolyether oil as a base oil.

17 Claims, No Drawings

LUBRICATING OIL COMPOSITION AND GREASE COMPOSITION TECHNICAL FIELD

TECHNICAL FIELD

The present invention relates to a lubricating oil composition and a grease composition, and more particularly to a lubricating oil composition and a grease composition with improved abrasion resistance, rust preventiveness, etc. to mating members by adding a fluorine-containing organophosphorus compound thereto.

BACKGROUND ART

The fluorine-containing organophosphorus compound has a good effect on the improvement of solvent resistance, chemical resistance, mold releasability, friction-abrasion resistance, etc. and thus has been so far used as various kinds of additives, a mold releasing agent, etc. So far well known fluorine-containing organophosphorus compounds includes, for example, phosphoric acid ester series or phosphonic acid ester series having linear perfluoroalkyl groups, and their utilization as a base oil for lubricating oil or grease has been limited, because they have a poor compatibility with perfluoropolyether oil, trifluorochloroethylene polymer oil, etc.

Phosphonic acid ester series having perfluoropolyether groups and having one terminal group consisting of phosphonic acid ester $RfRPO(OR')_2$ has been so far proposed. The phosphonic acid ester series are soluble in fluorine-containing base oil and have a good lubricability, but fail to fully satisfy recently imposed more stringent requirements for lubricability or rust preventiveness.

Patent Literature 1: JP-A-2003-27079

Phosphoric acid ester series having perfluoropolyether groups, or aryl phosphate, or phosphonate series, etc. having a mono- or poly-alkylene oxide bond group or not between the phosphorus and the fluorocarbon group have been also proposed. However, these compounds are liable to undergo hydrolysis, because the fluorine-containing group and the phosphoric acid group form a C—O—P bond, and thus have poor heat resistance and durability, failing to show a heat resistance, which is a characteristic inherent in fluoro series lubricating oil or grease.

Patent Literature 2: JP-A-6-136379

Patent Literature 3: JP-A-2002-510697

DISCLOSURE OF THE INVENTION

Problem to be Solved by the Invention

An object of the present invention is to provide a lubricating oil composition and a grease composition with distinguished abrasion resistance and rust preventiveness without impairing the heat resistance inherent in lubricating oil and grease based on perfluoropolyether oil as a base oil, by adding a fluorine-containing organophosphorus compound to perfluoropolyether base oil.

Means for Solving the Problem

The object of the present invention can be attained by a lubricating oil composition, which comprises a perfluoropolyether base oil, and a fluorine-containing polyether diphosphonic acid ester, represented by the following general formula:

$$(R_2O)(R_1O)P(O)(CH_2)_aCF(CF_3)[OCF_2CF(CF_3)]_bO(CF_2)_cO[CF(CF_3)CF_2O]_dCF(CF_3)(CH_2)_eP(O)(OR_3)(OR_4)$$

(where $R_1$, $R_2$, $R_3$, and $R_4$ are hydrogen atoms, alkyl groups, cycloalkyl groups, aryl groups, alkylaryl groups, aralkyl groups or any of the foregoing groups, some or whole of whose hydrogen atoms are substituted with halogen atoms, and subscripts a, b, c, d, and e are integers satisfying conditions of $2 \leqq a+e \leqq 8$, $b+d \leqq 28$, and $1 \leqq c \leqq 10$, and subscripts b and d can be 0), or by a grease composition, which comprises the lubricating oil composition and further a thickening agent.

EFFECT OF THE INVENTION

A lubricating oil composition, which comprises a perfluoropolyether base oil, and a fluorine-containing polyether diphosphonic acid ester as a new compound, and a grease composition, which comprises the lubricating oil composition and further a thickening agent, can show distinguished abrasion resistance and rust preventiveness without impairing the heat resistance inherent in both of the lubricating oil and the grease based on perfluoropolyether oil as a base oil.

BEST MODES FOR CARRYING OUT THE INVENTION

The fluorine-containing polyether diphosphonic acid ester compound represented by the foregoing general formula can be obtained by reaction of a fluorine-containing polyether dialkyl halide, represented by the following general formula:

$$X(CH_2)_aCF(CF_3)[OCF_2CF(CF_3)]_bO(CF_2)_cO[CF(CF_3)CF_2O]_dCF(CF_3)(CH_2)_eX \quad X: \text{Cl, Br, or I}$$

with one kind or two kinds of phosphonic acid or phosphonic acid ester (phosphite compound), preferably trialkyl phosphite, represented by the following general formulae:

$$(R_1O)(R_2O)P(OR) \quad [A]$$

$$(R_3O)(R_4O)P(OR) \quad [B]$$

R: hydrogen atom or a lower alkyl group $R_1$, $R_2$, $R_3$, and $R_4$: as defined above In the case using only one kind of the same phosphite compound [A] or [B], a diphosphonic acid ester compound with same kind of both terminal groups can be obtained, whereas in the case of using two kinds of mutually different phosphite compounds [A] and [B], a diphosphonic acid ester compound with two different kinds of terminal groups can be obtained.

The fluorine-containing polyether diphosphonic acid ester compound so synthesized includes, for example, the following compounds, where for the alkyl groups, cycloalkyl groups, alkylaryl groups, and aralkyl groups of $R_1$, $R_2$, $R_3$, and $R_4$, usually alkyl groups having 1 to 10 carbon atoms can be used. Why the condition of $2 \leqq a+e \leqq 8$ is set forth is due to easiness of synthesis, and why the conditions of $b+d \leqq 28$ and $1 \leqq c \leqq 10$, preferably $2 \leqq c \leqq 10$ are set forth are due to easy availability of raw materials for synthesis.

$$(C_2H_5O)_2P(O)(CH_2)_2CF(CF_3)OCF_2CF(CF_3)O(CF_2)_2OCF(CF_3)CF_2OCF(CF_3)(CH_2)_2P(O)(OC_2H_5)_2$$

$$(C_3H_7O)_2P(O)(CH_2)_aCF(CF_3)[OCF_2CF(CF_3)]_bO(CF_2)_4O[CF(CF_3)CF_2O]_dCF(CF_3)(CH_2)_eP(O)(OC_3H_7)_2$$

$$2 \leqq a+e \leqq 6 \text{ and } 2 \leqq b+d \leqq 6$$

$$(C_3F_7O)_2P(O)(CH_2)_2CF(CF_3)[OCF_2CF(CF_3)]_bO(CF_2)_6O[CF(CF_3)CF_2O]_dCF(CF_3)(CH_2)_2P(O)(OC_3H_7)_2$$

$$10 \leqq b+d \leqq 16$$

$$(C_3H_7O)(HO)P(O)(CH_2)_aCF(CF_3)[OCF_2CF(CF_3)]_bO(CF_2)_4O[CF(CF_3)CF_2O]_dCF(CF_3)(CH_2)_eP(O)(OH)(OC_3H_7)$$

$$2 \leqq a+e \leqq 6 \text{ and } 2 \leqq b+d \leqq 6$$

$(HO)_2P(O)(CH_2)_aCF(CF_3)[OCF_2CF(CF_3)]_bO(CF_2)_4O[CF(CF_3)CF_2O]_dCF(CF_3)(CH_2)_eP(O)(OH)_2$ $2 \leqq a+e \leqq 6$ and $2 \leqq b+d \leqq 6$ $(C_6H_{11}O)_2P(O)(CH_2)_2CF(CF_3)OCF_2CF(CF_3)O(CF_2)_2OCF(CF_3)CF_2OCF(CF_3)(CH_2)_2P(O)(OC_6H_{11})_2$ $(C_6H_{11}O)_2P(O)(CH_2)_2CF(CF_3)OCF_2CF(CF_3)O(CF_2)_2OCF(CF_3)CF_2OCF(CF_3)(CH_2)_2P(O)(OC_6H_4CH_3)_2$ $(CH_3C_6H_4O)_2P(O)(CH_2)_2CF(CF_3)OCF_2CF(CF_3)O(CF_2)_2 OCF(CF_3)CF_2OCF(CF_3)(CH_2)_2P(O)(OC_6H_4CH_3)_2$ $(C_6H_5O)_2P(O)(CH_2)_2CF(CF_3)[OCF_2CF(CF_3)]_2O(CF_2)_2O[CF(CF_3)CF_2O]_2CF(CF_3)(CH_2)_2P(O)(OC_6H_5)_2$ $(C_6H_5O)_2P(O)(CH_2)_2CF(CF_3)[OCF_2CF(CF_3)]_2O(CF_2)_2O[CF(CF_3)CF_2O]_2CF(CF_3)(CH_2)_2P(O)(OH)(OC_6H_5)$ Perfluoropolyether, to which such a fluorine-containing polyether diphosphonic acid ester compound is added and which is used as a base oil, can be represented by the following general formula:

$$RfO(CF_2O)_x(C_2F_4O)_y(C_3F_6O)_zRf$$

where x+y+z=2-200, and one or two of x, y and z can be 0. Specifically, those represented by the following general formulae (1)-(3) can be used, and also the one represented by the following general formula (4) can be also used. Rf is a perfluoro lower alkyl group having 1-5 carbon atoms, preferably 1-3 carbon atoms, such as a perfluoromethyl group, a perfluoroethyl group, a perfluoropropyl group, etc.

$$RfO(CF_2CF_2O)_m(CF_2O)_nRf \quad (1)$$

where m+n=3-200, and m:n=10-90:90-10. The $CF_2CF_2O$ group and the $CF_2O$ group are bonded to the main chain at random. The compound (1) can be obtained by complete fluorination of a precursor formed by photooxidation polymerization of tetrafluoroethylene.

$$RfO[CF(CF_3)CF_2O]_p(CF_2CF_2O)_q(CF_2O)_rRf \quad (2)$$

where p+q+r=3-300, q and r can be 0, and (q+r)/p=0-2. The $CF(CF_3)CF_2O$ group, the $CF_2CF_2O$ group, and the $CF_2O$ group can be bonded to the main chain at random. The compound (2) can be obtained by complete fluorination of a precursor formed by photooxidation polymerization of hexafluoropropene and tetrafluoroethylene.

$$RfO[CF(CF_3)CF_2O]_s(CF_2CF_2O)_tRf \quad (3)$$

where s+t=2-200, and t can be 0, and t/s=0-2, and the $CF(CF_3)CF_2O$ group and the $CF_2CF_2O$ group can be bonded to the main chain at random. The compound (3) can be obtained by complete fluorination of a precursor formed by photooxidation polymerization of hexafluoropropene and tetrafluoroethylene, or by anionic polymerization of hexafluoropropylene oxide, or tetrafluoroethylene oxide in the presence of a cesium fluoride catalyst, followed by treatment of the resulting acid fluoride compound having a terminated —$CF(CF_3)COF$ group with a fluorine gas.

$$F(CF_2CF_2CF_2O)_{2-100}C_2F_5 \quad (4)$$

The compound (4) can be obtained by anionic polymerization of 2,2,3,3-tetrafluorooxetane in the presence of a cesium fluoride catalyst, followed by treatment of the resulting fluorine-containing polyether $(CH_2CF_2CF_2O)_n$ with a fluorine gas at about 160° to about 300° C. under ultraviolet ray irradiation.

These perfluoropolyether base oils can be used alone or in a mixture, and in the case of using them as a lubricating oil, it is desirable that their viscosity (40° C.) is about 5 to about 2,000 $mm^2$/sec, preferably about 10 to about 1,500 $mm^2$/sec. When the viscosity is below about 5 $mm^2$/sec, no oil films can be maintained at high temperatures, resulting in abrasion of lubricated surfaces, whereas above about 2,000 $mm^2$/sec, the pour point (according to JIS K-2283) will be 10° C. or higher, so bearings, gears, chains, etc. will fail to work at low temperatures in the ordinary procedure, additional heating will be necessary for their working, consequently lacking in the necessary qualifications for use as the normal oil. The base oils can be used as grease by adding a thickening agent thereto. When the viscosity is below about 5 $mm^2$/sec in that case, evaporation amount will be increased, failing to satisfy the conditions that the evaporation amount must be not more than 1.5%, as set forth according to JIS ball-and-roller bearing grease, class 3, for the heat resistant grease, whereas when the viscosity is above about 2,000 $mm^2$/sec, the pour point (according to JIS K-2283) will be 10° C. or higher, same as in the case of the lubricating oil, and bearings, gears, chains, etc. will fail to work at low temperatures in the ordinary manner, and additional heating is necessary for their working, consequently lacking in the necessary qualifications for use as the normal grease.

When the fluorine-containing polyether diphosphonic acid ester compound is added to the perfluoropolyether base oil to prepare a lubricating oil composition, the diphosphonic acid ester compound can be used in a proportion of about 0.1 to about 20% by weight, preferably about 0.5 to about 5% by weight, on the basis of the composition consisting of these two components. If the proportion is below about 0.1% by weight, no sufficient effect of a lubricating oil can be obtained, whereas, even if used in a proportion of more than about 20% by weight, no such properties as to meet the cost performance can be obtained.

An effective grease composition can be prepared also with respect to the sealability by adding a thickening agent to such a lubricating oil composition. As a thickening agent, polytetrafluoroethylene [PTFE], tetrafluoroethylene-hexafluoropropene copolymer [FEP], perfluoroalkylene resin, etc., which have been so far used as a lubricating oil, can be also used. Polytetrafluoroethylene, prepared by emulsion polymerization, suspension polymerization, solution polymerization, etc. of tetrafluoroethylene, and further treated by thermal decomposition, electron beam irradiation, physical pulverization, etc. to reduce the number average molecular weight Mn from about 1,000 to about 1,000,000 down to about 1,000 to about 500,000, can be used. Copolymerization reaction of tetrafluoroethylene and hexafluoropropene, and successive treatment to lower the molecular weight can be carried out as in the case of polytetrafluoroethylene, and the resulting tetrafluoroethylene-hexafluoropropene copolymer having a lowered number average molecular weight Mn of about 1,000 to about 600,000 can be used. Control of the molecular weight can be also carried out by a chain transfer agent at the time of copolymerization reaction. The resulting powdery fluorine resin has usually a melting point of about 250° to about 340° C., and an average primary particle size of not more than about 500 μm, preferably about 0.1 to about 30 μm.

As other thickening agent than these fluoro resins, a metal soap such as Li soap, etc., urea resin, minerals such as bentonite, etc., an organic pigment, polyethylene, polypropylene, and polyamide can be also used. In view of the heat resistance and lubricating properties, aliphatic dicarboxylic acid metal salts (e.g. dilithium azelate), monoamide-monocarboxylic acid metal salts, monoester carboxylic acid metal salts, diurea, triurea, tetraurea, etc. can be used.

These fluoro resin powder, metal soap, urea, and other thickening agents can be used in a proportion of 0.1-50% by weight, preferably 10-40% by weight, on the basis of total with the base oil and the additive. When these thickening agents are used in a proportion of more than 50% by weight, the composition will be too hard, whereas in a proportion of less than 0.1% by weight, the thickening effect of the fluoro resin, etc. cannot be shown, resulting in acceleration of oil separation, and any improvement of anti-scattering and anti-leakage properties cannot be fully expected. The fluorine-containing polyether diphosphonic acid ester can be used in a proportion of about 0.1 to about 20% by weight, preferably about 0.5 to about 5% by weight, on the basis of the composition comprising these three components, as in the case of the lubricating oil composition.

The composition can contain, if necessary, other additives such as an antioxidant, a rust preventive, a corrosion inhibitor, an extreme pressure additive, an oiliness agent, a solid lubricant, etc., which have been so far used in the lubricant. The antioxidant includes, for example, a phenolic antioxidant such as 2,6-t-butyl-4-methylphenol, 4,4'-methylenebis(2,6-t-butylphenol), etc., and an amine-based antioxidant such as alkyldiphenylamine, triphenylamine, phenyl-α-naphthylamine, phenothiazine, alkylated phenyl-α-naphthylamine, phenithazine, alkylated phenithiazine, etc.

The rust preventive includes, for example, fatty acids, fatty acid amines, alkylsulfonic acid metal salts, alkylsulfonic acid amine salts, paraffin oxides, polyoxyethylene alkyl ether, etc. and the corrosion inhibitor includes, for example, benzotriazole, benzoimidazole, thiadiazole, etc.

The extreme pressure agent includes, for example, a phosphorus-based compound such as phosphoric acid esters, other phosphorous acid ester, phosphoric acid ester amine salts, etc., and a sulfur-based compound such as sulfides, disulfides, etc., a metal salt of sulfur-based compound such as dialkyldithiophosphoric acid metal salts, dialkyldithiocarbamic acid metal salts etc.

The oiliness agent includes, for example, fatty acids or their esters, higher alcohols, polyhydric alcohols, or their esters, aliphatic amines, fatty acid monoglycerides, etc. The other solid lubricant includes, for example, molybdenum disulfide, graphite, boron nitride, silane nitrides, etc.

Preparation of the composition can be carried out as follows a lubricating oil composition can be readily prepared by adding a fluorine-containing polyether diphosphonic acid ester to a perfluoropolyether base oil, followed only by stirring, and a grease composition can be prepared by a method (a) of adding predetermined amounts of a fluorine-containing polyether diphosphonic acid ester synthesized in advance, a thickening agent, and other necessary additives to a perfluoropolyether base oil, followed by thorough kneading through three rolls or in a high pressure homogenizer, or by a method (b) of adding a perfluoropolyether base oil and an aliphatic carboxylic acid to a heating and stirrable reactor vessel, then adding a predetermined amount of a metal hydroxide (and amine or alcohol) thereto to initiate a metal salt formation reaction (and amidization reaction or esterification reaction), followed by cooling, and further adding a fluorine-containing polyether diphosphonic acid ester thereto, followed by through kneading through three rolls or in a high pressure homogenizer.

EXAMPLES

The present invention will be described in detail below, referring to Examples.

Examples 1 to 12, and Comparative Examples 1 to 9

Base oil

A: $RfO[CF(CF_3)CF_2O]_pRf$ Viscosity (40° C.) 100 $mm^2$/sec.

B: $RfO[CF(CF_3)CF_2O]_pRf$ Viscosity (40° C.) 400 $mm^2$/sec

C: $F(CF_2CF_2CF_2O)_uRf$ Viscosity (40° C.) 100 $mm^2$/sec

D: $RfO(CF_2CF_2O)_m(CF_2O)_nRf$ Viscosity (40° C.) 160 $mm^2$/sec

E: $RfO[CF(CF_3)CF_2O]_p(CF_2O)_rRf$ Viscosity (40° C.) 230 $mm^2$/sec

Additive

I: $R_1,R_2,R_3,R_4=C_2H_5$, a,c,e=2, b,d=1

II: A mixture (wt. ratio=3:1) of $R_1,R_2,R_3,R_4=C_6H_5$, a,b,c,d,e=2, and $R_1,R_2,R_3=C_6H_5$, $R_4=H$, a,b,c,d,e=2

III: A mixture (wt. ratio=1:2:1) of $R_1,R_2,R_3,R_4=C_3H_7$, $2\leqq a+e\leqq 6$, $2\leqq b+d\leqq 6$, c=4, $R_1,R_2,R_3=C_3H_7$, $R_4=H$, $2\leqq a+e=\leqq 6$, $2\leqq b+d\leqq 6$, c=4, and $R_1$, $R_2$, $R_3$, $R_4=H$, $2\leqq a+e\leqq 6$, $2\leqq b+d\leqq 6$, c=4

IV: A mixture (wt. ratio=1:2:1) of $R_1,R_2,R_3,R_4=C_6H_{11}$, a,c,e=2, b,d=1, $R_1,R_2=C_6H_{11}$, $R_3,R_4=C_6H_4CH_3$, a,c,e=2, b,d=1, and $R_1,R_2,R_3,R_4=C_6H_4CH_3$, a,c,e=2, b,d=1

V: $R_1,R_2,R_3,R_4=C_3H_7$, a,e=2, c=6, $10\leqq b+d\leqq 16$

VI: $C_3F_7O[CF_2CF(CF_3)O]_vCF(CF_3)(CH_2)_2PO(OC_2H_5)_2$ $2\leqq v\leqq 6$

VII: $C_3F_7O[CF_2CF(CF_3)O]_vCF(CF_3)(CH_2)_2PO(OC_6H_5)_2$ $2\leqq v\leqq 8$

VIII: $C_3F_7O[CF_2CF(CF_3)O]_vCF(CF_3)(CH_2)_2OPO(OC_2H_5)_2$ $2\leqq v\leqq 6$ The afore-mentioned base oil and additive could be readily mixed only with stirring, whereby lubricating oil compositions could be prepared.

TABLE 1

| | Base oil | | Additive | |
|---|---|---|---|---|
| Examples | Species | wt. % | Species | wt. % |
| Example 1 | A | 99.5 | I | 0.5 |
| Example 2 | " | 98.0 | II | 2.0 |
| Example 3 | " | 90.0 | I | 10.0 |
| Example 4 | " | 98.0 | II | 2.0 |
| Example 5 | " | 99.0 | IV | 1.0 |
| Example 6 | B | 99.0 | V | 1.0 |
| Example 7 | " | 95.0 | I | 5.0 |
| Example 8 | C | 97.0 | III | 3.0 |
| Example 9 | " | 95.0 | II | 5.0 |
| Example 10 | D | 99.0 | V | 1.0 |
| Example 11 | E | 95.0 | II | 5.0 |
| Example 12 | " | 85.0 | IV | 15.0 |
| Comp. Ex. 1 | A | 100.0 | — | — |
| Comp. Ex. 2 | B | 100.0 | — | — |
| Comp. Ex. 3 | A | 98.0 | VI | 2.0 |
| Comp. Ex. 4 | " | 99.0 | VII | 1.0 |
| Comp. Ex. 5 | B | 95.0 | " | 5.0 |
| Comp. Ex. 6 | C | 97.0 | VI | 3.0 |
| Comp. Ex. 7 | D | 99.0 | " | 1.0 |
| Comp. Ex. 8 | E | 95.0 | VII | 5.0 |
| Comp. Ex. 9 | A | 98.0 | VIII | 2.0 |

These lubricating oil compositions were subjected to the following tests to determine abrasion marks, friction coefficient and rust preventiveness. The results are shown in the following Table 2.

<Shell Abrasion Test>

Test pieces [SUJ2 (a half inch), grade 20] were subjected to an abrasion test under such conditions as revolution rate: 20 revolutions/sec., load: 392.3N (40 kgf), temperature:room temperature, and time: 60 minutes, using a Shell Four-Ball Wear test machine to determine abrasion mark sizes formed on the test pieces after the test <Pendulum Test>

Aida type pendulum type friction tester was used under such conditions as a ball: SUJ2 (3/16 inch), a roller pin: SUJ2, temperature:room temperature, and load: 80 g at the right and left sides and 40 g at the center to determine a friction coefficient <Humidity Test>

Humidity test pieces (material: SPCC-SB, and dimension: 1.2 mm×60 mm×80 mm) were dipped into individual lubrication oil compositions, and then suspended in the humidity cabinet of the test apparatus at a temperature of 49°±1° C. and a humidity of 95% or higher and maintained in that state for 300 hours. Then, the test pieces were taken out of the tank to determine the degree of rust generation. The degree of rust generation is classified in the following rankings.

| Ranking | Degree of rust generation (%) |
|---|---|
| A | 0 |
| B | 1~10 |
| C | 11~25 |
| D | 26~50 |
| E | 51~100 |

<Heating Test>

50 ml of a mixture of a base oil and an additive was charged into a beaker having a capacity of 100 ml, and then the beaker was left to stand in a thermostat tank heated to 200° C. for 100 hours. After the test, changes in the appearance was visually inspected.

TABLE 2

| Examples | Shell abrasion test Abrasion mark size (mm) | Pendulum test Friction coefficient | Humidity test Rust preventive ranking | Heating test Change in appearance |
|---|---|---|---|---|
| Example 1 | 0.33 | 0.114 | A | No changes |
| Example 2 | 0.30 | 0.111 | A | " |
| Example 3 | 0.27 | 0.108 | A | " |
| Example 4 | 0.32 | 0.112 | A | " |
| Example 5 | 0.31 | 0.114 | A | " |
| Example 6 | 0.32 | 0.115 | A | " |
| Example 7 | 0.35 | 0.115 | A | " |
| Example 8 | 0.36 | 0.110 | A | " |
| Example 9 | 0.37 | 0.108 | A | " |
| Example 10 | 0.39 | 0.009 | A | " |
| Example 11 | 0.32 | 0.113 | A | " |
| Example 12 | 0.31 | 0.105 | A | " |
| Comp. Ex. 1 | 0.61 | 0.135 | E | No changes |
| Comp. Ex. 2 | 0.72 | 0.133 | E | " |
| Comp. Ex. 3 | 0.38 | 0.117 | B | " |
| Comp. Ex. 4 | 0.75 | 0.114 | D | " |
| Comp. Ex. 5 | 0.72 | 0.119 | D | " |
| Comp. Ex. 6 | 0.47 | 0.114 | B | " |
| Comp. Ex. 7 | 0.49 | 0.113 | C | " |
| Comp. Ex. 8 | 0.69 | 0.120 | D | " |
| Comp. Ex. 9 | 0.67 | 0.120 | B | Changed to brown (turbidity) |

Examples 13 to 25, and Comparative Examples 10 to 18

Grease compositions were prepared from the afore-mentioned base oils and additives together with the following thickening agents by the afore-mentioned preparation method (a) [but in the case of using the following thickening agent d by the afore-mentioned preparation method (b)].

Thickening agent a: Emulsion-polymerized PTFE (Mn: $10^5$~$2\times10^5$; melting point: 330° C.; average primary particle size: 0.2 μm)

b: Suspension-polymerized PTFE (Mn: $10^4$~$10^5$; melting point: 318° C.; average primary particle size: 5 μm)

c: Solution-polymerized FEP (Mn: $5\times10^4$~$15\times10^4$; melting point: 256° C. average primary particle size: 0.2 μm)

d: Dilithium azelate $LiOOC(CH_2)_7COOLi$

TABLE 3

| Examples | Base oil Species | Base oil wt. % | Additive Species | Additive wt. % | Thickening agent Species | Thickening agent wt. % |
|---|---|---|---|---|---|---|
| Example 13 | A | 77.5 | I | 1.5 | a | 22.0 |
| Example 14 | " | 75.0 | II | 5.0 | " | 20.0 |
| Example 15 | B | 70.0 | III | 2.0 | " | 28.0 |
| Example 16 | " | 65.0 | IV | 3.0 | " | 32.0 |
| Example 17 | " | 65.0 | V | 5.0 | " | 30.0 |
| Example 18 | " | 64.0 | II | 1.0 | b | 35.0 |
| Example 19 | " | 60.0 | I | 10.0 | d | 30.0 |
| Example 20 | C | 70.5 | " | 0.5 | a | 29.0 |
| Example 21 | " | 67.0 | II | 3.0 | " | 30.0 |
| Example 22 | D | 57.0 | IV | 5.0 | b | 38.0 |
| Example 23 | " | 69.0 | V | 1.0 | c | 30.0 |
| Example 24 | E | 65.0 | III | 3.0 | a | 32.0 |
| Example 25 | " | 55.0 | I | 18.0 | c | 27.0 |
| Comp. Ex. 10 | C | 65.0 | — | — | a | 35.0 |
| Comp. Ex. 11 | D | 70.0 | — | — | " | 30.0 |
| Comp. Ex. 12 | E | 85.0 | — | — | d | 15.0 |
| Comp. Ex. 13 | A | 75.0 | VI | 5.0 | a | 20.0 |
| Comp. Ex. 14 | " | 78.0 | VII | 2.0 | " | 20.0 |
| Comp. Ex. 15 | B | 72.0 | VI | 3.0 | " | 25.0 |
| Comp. Ex. 16 | C | 68.5 | " | 1.5 | b | 30.0 |
| Comp. Ex. 17 | D | 62.0 | " | 3.0 | " | 35.0 |
| Comp. Ex. 18 | E | 65.0 | VII | 5.0 | c | 30.0 |

The grease compositions were tested to determine the abrasion mark size and corrosion resistance. The results are shown in the following Table 4.

<Shell Abrasion Test>

The same as above

<Emcor Test (Degree of Corrosion) According to DIN 51802>

10 ml of grease was sealed into a 1306K bearing. The bearing was fixed to a SKF Emcor Method testing machine and tested in such a cycle condition as a revolution rate of 80 rpm, and revolution cycle of revolution continuation for 8 hours→revolution discontinuation for 16 hours→revolution continuation for 8 hours revolution discontinuation for 16 hours→revolution continuation for 8 hours→revolution discontinuation for 108 hours (=total 164 hours) to evaluate the corrosion state on the race way surface of bearing outer race according to the following evaluation standard. In the test, an aqueous 0.1 wt. % sodium chloride solution was used.

| Ranting | Degree of Corrosion | Description |
|---|---|---|
| 0 | No corrosion | Nothing |
| 1 | Traces of corrosion | Not more than 3 corrosion sites, none having a diameter greater than 1 mm |
| 2 | Slight corrosion | Corrosion covering not more than 1% of surface, but or larger corrosion sites than for rating 1 |
| 3 | Moderate corrosion | Corrosion covering more than 1%, but not more than 5% of surface |
| 4 | Severe corrosion | Corrosion covering more than 5%, but not more than 10% of surface |
| 5 | Very severe corrosion | Corrosion covering more than 10% of surface |

TABLE 4

| Examples | Shell abrasion test Abrasion mark size (mm) | Emcor test Rating |
|---|---|---|
| Example 13 | 0.66 | 0 |
| Example 14 | 0.62 | 0 |
| Example 15 | 0.71 | 0 |
| Example 16 | 0.69 | 0 |
| Example 17 | 0.67 | 0 |
| Example 18 | 0.73 | 0 |
| Example 19 | 0.65 | 0 |
| Example 20 | 0.79 | 0 |
| Example 21 | 0.98 | 0 |
| Example 22 | 0.97 | 0 |
| Example 23 | 0.99 | 0 |
| Example 24 | 0.70 | 0 |
| Example 25 | 0.60 | 0 |
| Comp. Ex. 10 | 2.88 | 5 |
| Comp. Ex. 11 | 3.04 | 5 |
| Comp. Ex. 12 | 2.75 | 5 |
| Comp. Ex. 13 | 0.74 | 1 |
| Comp. Ex. 14 | 2.45 | 4 |
| Comp. Ex. 15 | 0.91 | 1 |
| Comp. Ex. 16 | 1.01 | 2 |
| Comp. Ex. 17 | 1.15 | 1 |
| Comp. Ex. 18 | 2.62 | 3 |

INDUSTRIAL UTILITY

The present lubricating composition and grease composition can be applied to uses to which perfluoropolyether oil has been so far applied, particularly sliding parts requiring the lubricability or rust preventiveness, or exposed to corrosive gases, for example, sliding parts of ball-and-roller bearings, slide bearings, sintering bearings, gears, valves, cocks, oil seals, electric contacts, etc.

Specifically, they can be effectively applied to sliding parts, for example, bearings requiring the heat resistance, low-temperature characteristics, and load resistance, typically hub units, traction motor, fuel injection systems, alternators, etc. of automobiles; gear parts requiring the wear resistance, low friction characteristics, and high torque efficiency, typically power transmission devices, power wind motors, wipers, etc. of automobiles; bearings requiring a low torque or low outgassing, typically hard disc, flexible disc memory devices, compact disc drives, optomagnetic disc drives used in the information equipment; bearings, gears, etc. used in vacuum pumps, resin production apparatuses, conveyers, lumber industry machinery, chrome coating apparatuses, etc. or electric contacts in electronic devices used in breaker-interrupting devices-relay-switch, etc.

The invention claimed is:

1. A lubricating oil composition, which comprises a perfluoropolyether base oil, and a fluorine-containing polyether diphosphonic acid ester, represented by the following general formula:

$$(R_2O)(R_1O)P(O)(CH_2)_aCF(CF_3)[OCF_2CF(CF_3)]_bO(CF_2)_cO[CF(CF_3)CF_2O]_dCF(CF_3)(CH_2)_eP(O)(OR_3)(OR_4)$$

(where $R_1$, $R_2$, $R_3$, and $R_4$ are hydrogen atoms, alkyl groups, cycloalkyl groups, aryl groups, alkylaryl groups, aralkyl groups, or any of the foregoing groups, some or whole of whose hydrogen atoms are substituted with halogen atoms, and subscripts a, b, c, d, and e are integers satisfying conditions of $2 \leqq a+e \leqq 8$, $b+d \leqq 28$, and $1 \leqq c \leqq 10$, and subscripts b and d can be 0).

2. A lubricating oil composition according to claim 1, wherein the fluorine-containing polyether diphosphonic acid ester with $2 \leqq c \leqq 10$ in the general formula representing the fluorine-containing polyether diphosphonic acid ester is used.

3. A lubricating oil composition according to claim 1, wherein the fluorine-containing polyether diphosphonic acid ester is used in a proportion of 0.1-20 wt. % in the composition.

4. A lubricating oil composition according to claim 1, wherein the perfluoropolyether is a compound represented by the following general formula:

$$RfO(CF_2O)_x(C_2F_4O)_y(C_3F_6O)_zRf$$

(where Rf is a perfluoroalkyl group having 1-5 carbon atoms, x+y+z=2-200, one or two of x, y, and z can be 0, and the $CF_2O$ group, the $C_2F_4O$ group and the $C_3F_6O$ group are groups in random combination in the main chain).

5. A lubricating oil composition according to claim 4, wherein the perfluoropolyether is a compound represented by the following general formula:

$$RfO(CF_2CF_2O)_m(CF_2O)_nRf$$

(where Rf is a perfluoroalkyl group having 1-5 carbon atoms, m+n=3-200, m:n=10-90:90-10, and the $CF_2CF_2O$ group and the $CF_2O$ group are groups in random combination in the main chain).

6. A lubricating oil composition according to claim 4, wherein the perfluoropolyether is a compound represented by the following general formula:

$$RfO[CF(CF_3)CF_2O]_p(CF_2CF_2O)_q(CF_2O)_rRf$$

(where Rf is a perfluoroalkyl group having 1-5 carbon atoms, p+q+r=3-200, q and r can be 0, (q+r)/p=0-2, and the $CF(CF_3)CF_2O$ group, the $CF_2CF_3O$ group and the $CF_2O$ group are groups in random combination in the main chain).

7. A lubricating oil composition according to claim 4, wherein the perfluoropolyether is a compound represented by the following general formula:

$$RfO[CF(CF_3)CF_2O]_s(CF_2CF_2O)_tRf$$

(where Rf is a perfluoroalkyl group having 1-5 carbon atoms, s+t=2-200, t can be 0, t/s=0-2, and the $CF(CF_3)CF_2O$ group and the $CF_2CF_2O$ group are groups in random combination in the main chain).

8. A lubricating oil composition according to claim 1, wherein the perfluoropolyether is a compound represented by the following general formula:

$$F(CF_2CF_2CF_2O)_{2-100}C_2F_5.$$

9. A grease composition, which comprises a perfluoropolyether base oil, a fluorine-containing polyether diphosphonic acid ester, represented by the following general formula:

$$(R_2O)(R_1O)P(O)(CH_2)_aCF(CF_3)[OCF_2CF(CF_3)]_bO(CF_2)_cO[CF(CF_3)CF_2O]_dCF(CF_3)(CH_2)_eP(O)(OR_3)(OR_4)$$

(where $R_1$, $R_2$, $R_3$, and $R_4$ are hydrogen atoms, alkyl groups, cycloalkyl groups, aryl groups, alkylaryl groups, aralkyl groups, or any of the foregoing groups, some or whole of whose hydrogen atoms are substituted with halogen atoms, and subscripts a, b, c, d, and e are integers satisfying conditions of $2 \leqq a+e \leqq 8$, $b+d \leqq 28$, and $1 \leqq c \leqq 10$, and subscripts b and d can be 0), and a thickening agent.

10. A grease composition according to claim 9, wherein the fluorine-containing polyether diphosphonic acid ester with $2 \leqq c \leqq 10$ in the general formula representing the fluorine-containing polyether diphosphonic acid ester is used.

11. A grease composition according to claim 9, wherein the fluorine-containing polyether diphosphonic acid ester is used in a proportion of 0.1-20 wt. % in the composition.

12. A grease composition according to claim 9, wherein the thickening agent is used in a proportion of 0.1-50 wt. % in the composition.

13. A grease composition according to claim 9, wherein the perfluoropolyether is a compound, represented by the following general formula:

$$RfO[CF_2O]_x(C_2F_4O)_y(C_3F_6O)_zRf$$

(where Rf is a perfluoroalkyl group having 1-5 carbon atoms, x+y+z=2-200, one or two of x, y and z can be 0, and the $CF_2O$ group, the $C_2F_4O$ group and the $C_3F_6O$ group are groups in random combination in the main chain).

14. A grease composition according to claim 13, wherein the perfluoropolyether is a compound, represented by the following general formula:

$$RfO(CF_2CF_2O)_m(CF_2O)_nRf$$

(where Rf is a perfluoroalkyl group having 1-5 carbon atoms, m+n=3-200, m:n=10-90:90-10, and the $CF_2CF_2O$ group and the $CF_2O$ group are groups in random combination in the main chain).

15. A grease composition according to claim 13, wherein the perfluoropolyether is a compound, represented by the following general formula:

$$RfO[CF(CF_3)CF_2O]_p(CF_2CF_2O)_q(CF_2O)_rRf$$

(where Rf is a perfluoroalkyl group having 1-5 carbon atoms, p+q+r=3-200, q and r can be 0, (q+r)/p=0-2, and the $CF(CF_3)CF_2O$ group, the $CF_2CF_2O$ group and the $CF_2O$ group are groups in random combination in the main chain).

16. A grease composition according to claim 13, wherein the perfluoropolyether is a compound, represented by the following general formula:

$$RfO[CF(CF_3)CF_2O]_s(CF_2CF_2O)_tRf$$

(where Rf is a perfluoroalkyl group having 1-5 carbon atoms, s+t=2-200, t can be 0, t/s=0-2, and the $CF(CF_3)CF_2O$ group and the $CF_2CF_2O$ group are groups in random combination in the main chain).

17. A grease composition according to claim 9, wherein the perfluoropolyether is a compound, represented by the following general formula:

$$F(CF_2CF_2CF_2O)_{2-100}C_2F_5.$$

* * * * *

UNITED STATES PATENT AND TRADEMARK OFFICE

CERTIFICATE OF CORRECTION

PATENT NO. : 7,709,424 B2
APPLICATION NO. : 11/791306
DATED : May 4, 2010
INVENTOR(S) : Akihiko Shimura and Tatsuya Hashimoto It is certified that error appears in the above-identified patent and that said Letters Patent is hereby corrected as shown below:

On the Title Page Item (54) and Col. 1, lines 1-2
The title should be changed from

"LUBRICATING OIL COMPOSITION AND GREASE COMPOSITION TECHNICAL FIELD"

to

--LUBRICATING OIL COMPOSITION AND GREASE COMPOSITION--

In the Specification
Column 2, line 28, should be changed from
"$(CF_3)CF_2O]_dCF(CF_3)(CH_2)_eX$ X: Cl, Br, or I"

to
--$(CF_3)CF_2O]_dCF(CF_3)(CH_2)_eX$--

Column 2, blank line 29 should be added
--X: Cl, Br, or I--

Column 8, line 46 should be changed from
"continuation for 8 hours revolution discontinuation for 16"
to
--continuation for 8 hours→revolution discontinuation for 16--

Signed and Sealed this
Sixteenth Day of August, 2011

David J. Kappos

David J. Kappos
*Director of the United States Patent and Trademark Office*